US007011487B2

(12) United States Patent
Kafka et al.

(10) Patent No.: US 7,011,487 B2
(45) Date of Patent: Mar. 14, 2006

(54) APPARATUS FOR TRANSPORT AND DELIVERY OF ARTICLES

(75) Inventors: Alfred J. Kafka, Harbor Springs, MI (US); Harry E. Smith, Concord, OH (US); Wallace I. Miller, Jr., Clevelend, OH (US); Keith Westphal, Petoskey, MI (US); Jon L. Coveyou, Petoskey, MI (US)

(73) Assignee: Jervis B. Webb Company, Farmington Hills, MI (US)

( * ) Notice: Subject to any disclaimer, the term of this patent is extended or adjusted under 35 U.S.C. 154(b) by 83 days.

(21) Appl. No.: 10/221,048

(22) PCT Filed: Mar. 6, 2001

(86) PCT No.: PCT/US01/40244

§ 371 (c)(1),
(2), (4) Date: Jan. 24, 2003

(87) PCT Pub. No.: WO01/66456

PCT Pub. Date: Sep. 13, 2001

(65) Prior Publication Data

US 2003/0185660 A1 Oct. 2, 2003

Related U.S. Application Data

(63) Continuation-in-part of application No. 09/618,133, filed on Jul. 17, 2000, now abandoned.

(60) Provisional application No. 60/187,011, filed on Mar. 6, 2000.

(51) Int. Cl.
*B66F 9/06* (2006.01)

(52) U.S. Cl. ..... 414/663; 414/459; 414/667; 414/911

(58) Field of Classification Search ..... 414/280, 414/282, 459, 659–663, 667, 671, 911
See application file for complete search history.

(56) References Cited

U.S. PATENT DOCUMENTS

| | | | |
|---|---|---|---|
| 1,244,783 | A | 10/1917 | Ruckes |
| 1,717,194 | A | 6/1929 | Daoust |
| 1,729,330 | A | 9/1929 | Dart |
| 2,298,145 | A | 10/1942 | Merrylees |
| 2,505,352 | A | 4/1950 | Dillon |
| 2,815,878 | A | 12/1957 | Vance |
| 2,916,171 | A | 12/1959 | Schwarz |

(Continued)

FOREIGN PATENT DOCUMENTS

JP 4-129906 4/1992

OTHER PUBLICATIONS

AUROSYS. Automatic Reel And Materials Handling (Brochure), MAN Roland, 8 pages (undated).

(Continued)

*Primary Examiner*—James W. Keenan
(74) *Attorney, Agent, or Firm*—Dickinson Wright PLLC

(57) ABSTRACT

A vehicle (10) includes a hollow transfer device (20), a side translating assembly (40), and a lift mast assembly (90). The transfer device has at least one substantially open end and a longitudinal opening intersecting the substantial open end. The lift mast assembly is cooperatively associated with the transfer device to move the transfer device substantially vertically, and the side translating assembly is also operatively associated with the transfer device to move the transfer device substantially horizontally between at least one side of the vehicle and a center of the vehicle. The invention contemplates use in a newsprint roll handling apparatus.

13 Claims, 12 Drawing Sheets

U.S. PATENT DOCUMENTS

| | | | |
|---|---|---|---|
| 2,918,186 | A | 12/1959 | Cirillo |
| 3,050,205 | A | 8/1962 | Coash et al. |
| 3,237,980 | A | 3/1966 | Helms |
| 3,253,851 | A | 5/1966 | Gilbert |
| 3,435,973 | A | 4/1969 | Dickey |
| 3,490,622 | A | 1/1970 | Brackin |
| 3,549,025 | A | 12/1970 | Messner |
| 3,583,586 | A | 6/1971 | Burton |
| 3,741,419 | A | 6/1973 | Bergerhoff et al. |
| 3,861,732 | A | 1/1975 | Piper |
| 3,896,957 | A | 7/1975 | Sinclair |
| 4,127,205 | A | 11/1978 | Farmer et al. |
| 4,227,850 | A | 10/1980 | Farmer et al. |
| 4,240,773 | A | 12/1980 | Terry |
| 4,265,583 | A | 5/1981 | Baird et al. |
| 4,318,661 | A | 3/1982 | Helm |
| 4,388,033 | A | 6/1983 | Pipes |
| 4,406,570 | A | 9/1983 | Duncan et al. |
| 4,435,117 | A | 3/1984 | House |
| 4,541,766 | A | 9/1985 | Dahl |
| 4,549,841 | A | 10/1985 | Ishige |
| 4,573,858 | A | 3/1986 | Sinclair |
| 4,773,807 | A | 9/1988 | Kroll et al. |
| 4,941,798 | A | 7/1990 | Meier |
| 4,974,520 | A | 12/1990 | Dehne |
| 4,983,094 | A | 1/1991 | Ping |
| 5,007,522 | A | 4/1991 | Focke et al. |
| 5,024,477 | A | 6/1991 | Slezak |
| 5,056,982 | A | 10/1991 | Stockham |
| 5,076,751 | A | 12/1991 | Kafka |
| 5,163,727 | A | 11/1992 | Slezak et al. |
| 5,217,343 | A | 6/1993 | Bostad et al. |
| 5,236,294 | A | 8/1993 | Willis |
| 5,249,903 | A | 10/1993 | Green et al. |
| 5,253,974 | A | 10/1993 | Williams |
| 5,388,955 | A | 2/1995 | Schroder |
| 5,417,464 | A | 5/1995 | Seaberg et al. |
| 5,468,116 | A | 11/1995 | Reichert et al. |
| 5,516,255 | A | 5/1996 | Tygard |
| 5,524,415 | A | 6/1996 | Pachinger et al. |
| 5,797,557 | A | 8/1998 | Wang et al. |
| 5,984,617 | A | 11/1999 | Seaberg |
| 6,155,516 | A | 12/2000 | Lehrieder et al. |

OTHER PUBLICATIONS

SR/F—The New Standard In Warehouse Productivity (Brochure), AFT, Inc., 4 pages (undated).

Brochure: Specializing In Custom Load Handling Applications, Webb-Triax Company, 2000 (6 pages).

Brochure: "MS/RV—Mobile Storage And Retrieval Vehicle, " Webb-Triax Company, 1998 (4 pages).

"Automating Newsprint Storage," Rosenberg, Jim, Editor & Publisher, Jul. 22, 1989 (2 pages).

"Des Moines will automate newsprint handling with AUROsys," Rosenberg, Jim, Editor, & Publisher, May 15, 1999 (2 pages).

Jervis B. Webb Company; "Automated Electrified Monorail Systems" 1990 (6 pages).

IDAB Incorporated; "IDAB Press Delivery AGV System" Sep. 1990 (4 pages).

Volvo; "Forklift Carrier FS-4201" 7 pages (undated).

FMC; "The Miami Herald Reel Room Automated Guided Vehicle System" May 11, 1999 (3 pages).

International Search Report dated Jul. 26, 2001 for International Application No. PCT/US01/40244, filed Mar. 6, 2001, entitled "Apparatus For Transport And Delivery Of Articles" (6 pages).

APPARATUS FOR TRANSPORT AND DELIVERY OF ARTICLES

This application is a National Stage of International Application No. PCT/US01/40244, filed on Mar. 6, 2001, which is a continuation-in-part of U.S. patent application Ser. No. 09/618,133, filed Jul. 17, 2000, now abandoned, which claims priority to U.S. Provisional Patent Application Ser. No. 60/187,011, filed on Mar. 6, 2000. The disclosures of the above applications are incorporated herein by reference.

FIELD OF THE INVENTION

Background of the Invention

Articles stored in a storage facility are often arranged in multiple-level storage racks along the sides of aisles used by vehicles, such as fork trucks, to load, unload and transport the articles. FIG. 1 illustrates such a storage facility where rolls of paper, used to print newspapers, are stored in multiple-level storage racks. To increase the number of articles stored in a storage facility, the aisles are made as narrow as possible so that there is more space to store the articles. The width of the aisles is usually determined by the width of the vehicles and by the need for space to maneuver the vehicles to load and unload articles.

Therefore, it is desirable that the vehicles require less aisle space to load, unload and transport articles. Various conventional vehicles currently in use generally require relatively wide aisles. For example, in the newspaper printing industry, there are currently four types of conventional vehicles for transport and delivery of rolls of paper stored in newsprint reel rooms. Each type of conventional vehicle requires relatively wide aisles.

The first type of conventional vehicle is the straddle style fork truck. The fork truck includes a pair of forks and a lift mast used to raise and lower the forks. The forks are usually placed at the rear end of the fork truck in parallel with the direction of truck travel. To load a roll of paper onto the fork truck, the fork truck is maneuvered into a position where the truck is perpendicular to the aisle with the end of the fork truck faces the roll to be loaded. Then the lift mast positions the forks at the same level as the roll to be loaded, and the fork truck moves backwards to position the forks under the roll. Next, the lift mast raises the forks to place the roll on the forks. The roll is carried on the fork truck with the roll's centerline parallel to the direction of truck travel. A similar maneuver of the fork truck is needed to unload the roll from the fork truck into a storage rack. This type of vehicle requires a wide aisle to maneuver the vehicle into the transfer position.

The second type is a low profile unit load carrier, which employs a cradle atop of the vehicle to support the roll during transport. Similar to a vehicle of the first type, a vehicle of the second type also carries, picks up and drops off a roll with the centerline of the roll parallel to the direction of vehicle travel. This requires wide aisles for reorientation of the vehicle so that the vehicle is in position for pick up and drop off. In addition, the vehicle is not equipped with a mechanism to pick up or drop off a roll off board the vehicle. A major portion of the vehicle must be below the rack to position the cradle just below the roll for pick up or drop off. Thus, the vehicle cannot transfer at floor level and requires additional rack space so that the vehicle can be placed below the rack.

The third type of vehicle is a side-loading vehicle. This type of vehicle also has a pair of forks and a lift mast used to raise and lower the forks, but the forks and lift mast are positioned to load and unload paper rolls from a side of the vehicle as opposed to from the end of the vehicle as is the case for the first type of vehicle. In other words, the forks and lift mast face the side of the vehicle and are perpendicular to the direction of vehicle travel. The lift mast is mounted on a translating carriage assembly, which moves the lift mast and fork between the center and a side of the vehicle. The vehicle carries the roll with the roll's centerline perpendicular to the direction of vehicle travel. To load or unload a roll of paper, the vehicle must be oriented in the proper travel direction prior to entry into the aisle because the vehicle can only load or unload from one side of the vehicle. The vehicle then is parked parallel to the storage racks with the lift mask and forks facing the roll to be loaded. The translating carriage assembly moves the lift mast and forks towards the roll and places the forks under the roll. Then the lift mast raises the forks to place the roll on the forks. One advantage of this type of vehicle is that the vehicle does not need to be maneuvered in a position perpendicular to the aisle to load and unload a roll, and thus, does not need the aisle space to maneuver into a transfer position perpendicular to the aisle. However, the width of the vehicle is increased because the lift mast and forks are mounted side-by-side on the vehicle.

The forth type is a counterbalance style fork truck, which is similar to the first type of vehicle but the forks are attached to the lift mast via a turret assembly. The turret assembly allows the forks to rotate 180 degree from one side of the vehicle to the other side. In other words, the turret assembly can position the forks to face either side of the vehicle or the rear of the vehicle. The vehicle includes a side translating assembly that can move the lift mast and forks towards either side of the vehicle to load and unload paper rolls in a manner similar to the third type. A drawback of this design is that the turret assembly is complicated and expensive, and requires significant routine maintenance.

The above description relates generally to material handling vehicles and, more particularly, to free ranging type vehicles. Another type of material handling vehicle is an automated storage and retrieval (AS/R) vehicle. AS/R vehicles have numerous applications including use in newspaper printing facilities. One example of a representative newspaper printing facility as well as a representative AS/R vehicle for a reelroom is illustrated and described in U.S. Pat. No. 5,076,751, issued Dec. 31, 1991 to Alfred J. Kafka and assigned to the assignee of the present application. As is generally indicated in the '751 patent and as generally known in the art, AS/R systems are generally guided by top and bottom rails operatively engaged by upper and lower pairs of wheels (see reference numerals 34 and 35 in FIG. 4 of the '751 patent). The rails define an aisle between a plurality of reelstand load stations and roll storage bins. In order to store and retrieve newspaper rolls from both sides of an aisle without requiring turn-around space, the AS/R vehicle is provided with an elevator and carrier. The elevator operates to move the carrier to an elevation where the carrier can extend to engage the cylindrical newsprint roll. The elevator then lifts the carrier and raises the roll whereupon the vehicle can move the roll from the pickup station to one of the plurality of storage bins and then, when needed, from the bin to one of the reelstand load stations.

The multi-rail guidance of AS/R vehicles permit the vehicles to operate at greater speeds and with greater stability when compared to other material handling vehicles, such as fork lift trucks (generally free ranging vehicles) and transfer cars (which have only floor disposed guide rails and include additional lower wheels for stability). In fact, AS/R vehicles commonly operate at two to three times the speed of standard transfer cars.

While the machine described in the '751 patent generally functions in a satisfactory manner, the carrier of the machine can engage a newsprint roll only if the roll is sitting above the floor. More particularly, as is illustrated in FIG. 4 of the '751 patent, the carrier includes telescoping arms that are positioned above the wheeled base even when the elevator is in its fully lowered position. As a result, the newsprint roll must be positioned above the wheeled base on a cradle or pedestal (FIG. 6 of the '751 patent) so that the telescoping arms of the carrier can properly engage the roll. This necessary elevation differential between the wheeled base and the bottom of the newsprint roll can exceed twenty four (24) inches and limits the vertical space available for roll storage.

The need for a cradle negatively impacts the space available for roll storage. This deficiency can be addressed, but only in part, by placing the lower guide rail and the wheeled base of the machine in a pit (see FIG. 4 of the '751 patent). However, the rolls must still be placed on a cradle, albeit a shorter one, to permit the telescoping arms of the carrier to engage the roll. In some installations, vertical space or head room is at such a premium that even short cradles prevent multi-level storage that would otherwise be available. Further, the pit is costly for new construction and oftentimes not feasible when retrofitting an existing facility.

Design requirements for newsprint applications further limit options for accommodating the above-discussed headroom constraints presented by AS/R machines. For example, the significant weight of newsprint rolls require that any solution have a robust design capable of withstanding the significant loadings. Newsprint rolls commonly have a length of up to 12.5 feet and can weigh in excess of 2500 pounds. When the AS/R machine picks up or places these rolls, the loads are suspended to the right and left of the vehicle center thereby generating significant torque loading on the vehicle frame and elevator. To achieve widespread acceptance in AS/R applications, such as newsprint reel-rooms, any solution to the headroom constraints must be able to better accommodate these heavy loads.

SUMMARY OF THE INVENTION

This invention provides an apparatus for transport and delivery of articles, which does not have one or more drawbacks associated with conventional vehicles.

In accordance with one aspect of the invention, a transfer device includes a hollow member that has at least one substantially open end and a longitudinal opening. The longitudinal opening intersects the substantial open end of the hollow member so that the hollow member is able to slide around an article while the article is placed in a storage rack. As a result, at least a portion of the article enters the hollow member from the open end of the hollow member.

In accordance with another aspect of the invention, a vehicle for transport and delivery of an article includes a hollow transfer device, a side translating assembly and a lift mast assembly. The transfer device has at least one substantially open end and a longitudinal opening intersecting the substantial open end. The lift mast assembly is operatively associated the transfer device to move the transfer device substantially vertically, and the side translating assembly is also operatively associated the transfer device to move the transfer device substantially horizontally between at least one side of the vehicle and a center of the vehicle.

In accordance with a further aspect of the invention, a vehicle for transport and delivery of an article includes a transfer device, a side translating assembly and a lift mast assembly. The side translating assembly includes at least one rail, which supports and guides the transfer device to travel horizontally between at least one side of the vehicle and a center of the vehicle. The lift mast assembly is cooperatively associated the side translating assembly to move the side translating assembly vertically.

The transfer device and vehicle of the present invention may have a number of advantages over conventional vehicles. For example, a vehicle of the present invention does not require aisle space to maneuver into a transfer position to load or unload because the vehicle may load and unload paper rolls from one or both sides of the vehicle. This feature allows narrow aisles and thus more space for storage.

Another advantage of the present invention is that a vehicle of the present invention may be made almost as narrow as the width of the paper rolls. Thus, the aisles can be made almost as narrow as the width (height) of the paper rolls. In contrast, the minimum aisle width required by the third type of conventional vehicle is the width of the paper rolls plus the width of the lift mast assembly, and the minimum aisle width for the fourth type of conventional vehicle is the width of the paper rolls plus the space required by the turret assembly. Further, the side translating assembly of the present invention is simple and inexpensive, and has a narrow profile. The narrow profile of the side translating assembly allows the portion of the side translating assembly attached to the transfer device to easily extend into a storage rack to load or unload a paper roll with minimum increase of rack space to accommodate the side translating assembly.

Another aspect of the present invention is generally directed to a newsprint roll handling apparatus having a storage and retrieval machine with the vertical carriage that is capable of lifting or delivering items from or to surfaces at or even below the wheeled truck or base of the vehicle and to its sides.

A still further object of the present invention is to include a vertical carriage having a support frame, carrier, and shuttle oriented in a manner that accommodates the heavy loading present in newsprint roll applications. The carriage components are preferably positioned such that the shuttle is disposed vertically above the carrier to operably couple the carrier to the frame for movement in a plane substantially perpendicular to the vehicle's axis of movement.

In view of the above, one embodiment of the present invention is directed to a vertical carriage for use in a vehicle for transporting and delivering an article wherein the vertical carriage includes a carrier, a horizontal support frame, and a shuttle. The carrier has at least one substantially open end and a longitudinal opening intersecting the open end. The shuttle is cooperatively associated with the carrier and support frame to couple a carrier to the support frame for movement in a plane substantially parallel to the longitudinal opening of the carrier. The invention is also directed to a vehicle having the vertical carriage as well as a newsprint roll handling apparatus consisting in part of the vehicle and vertical carriage.

Further scope of applicability of the present invention will become apparent from the following detailed description, claims, and drawings. However, it should be understood that the detailed description and specific examples, while indicating preferred embodiments of the invention, are given by way of illustration only, since various changes and modifications within the spirit and scope of the invention will become apparent to those skilled in the art.

BRIEF DESCRIPTION OF THE DRAWINGS

The present invention will become more fully understood from the detail description given here below, the appended claims, and the accompanying drawings in which:

DETAILED DESCRIPTION OF PREFERRED EMBODIMENTS

Figure 1:
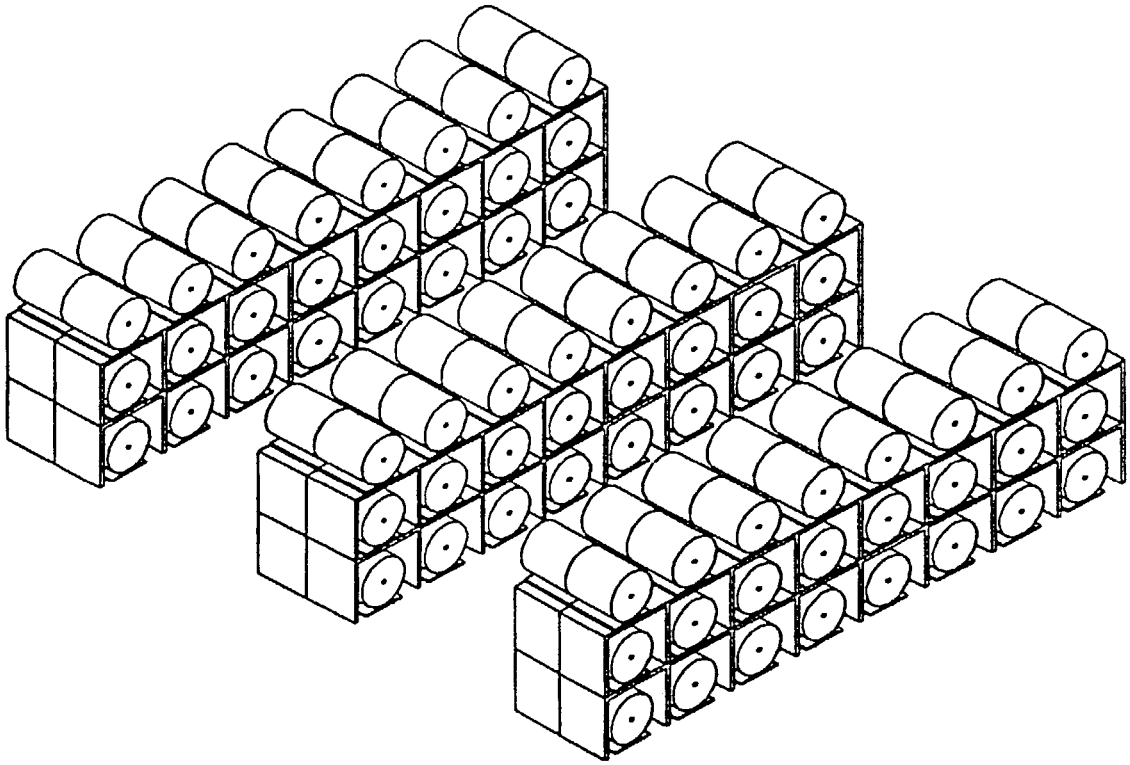
FIG. 1 is a perspective view of a storage facility for storing rolls of paper used in the printing of newspapers.
Figure 2:
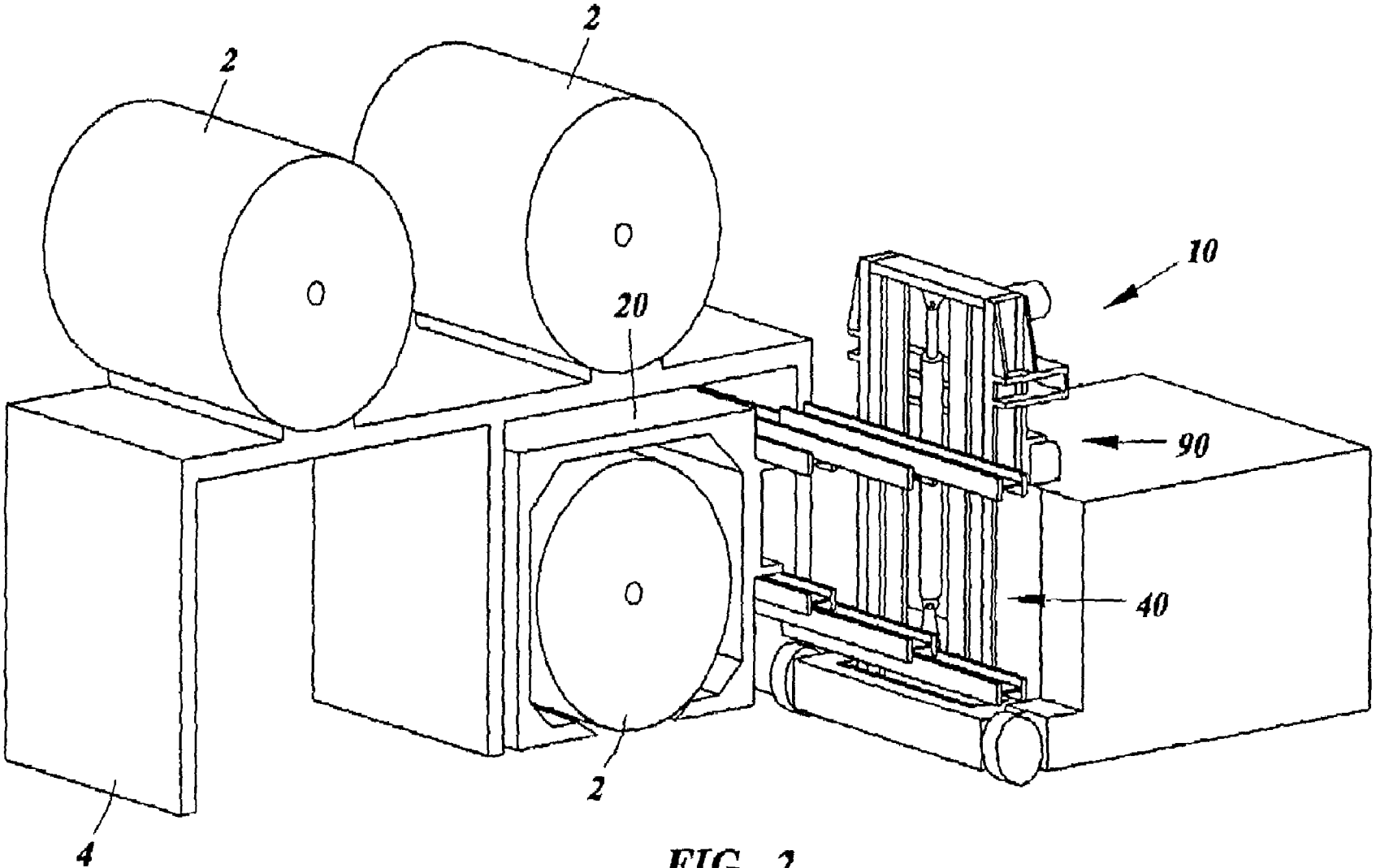
FIG. 2 is a perspective view of a vehicle of the present invention.
Figure 3A:
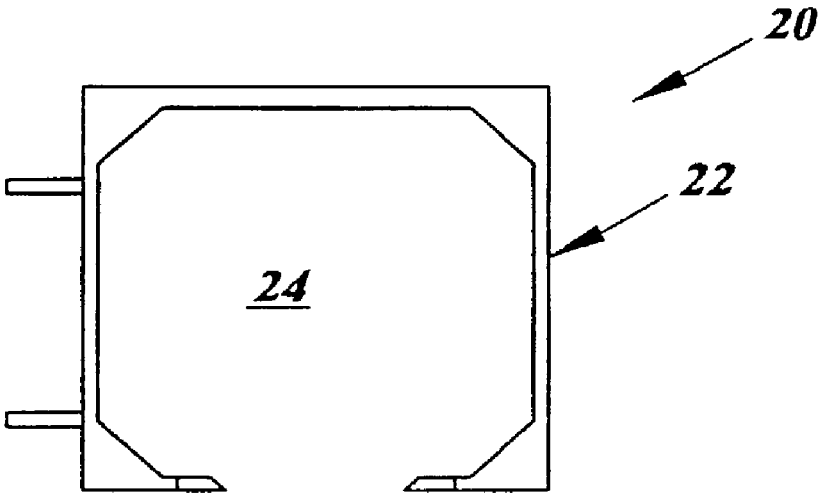
FIG. 3A is a side view of the transfer device shown in FIG. 2.
Figure 3B:
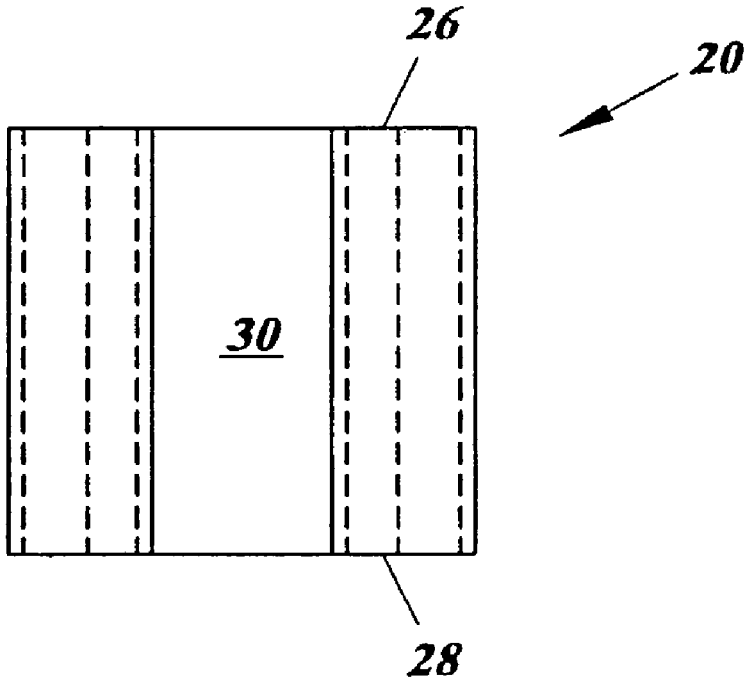
FIG. 3B is a bottom view of the transfer device shown in FIG. 2.
Figure 4A:
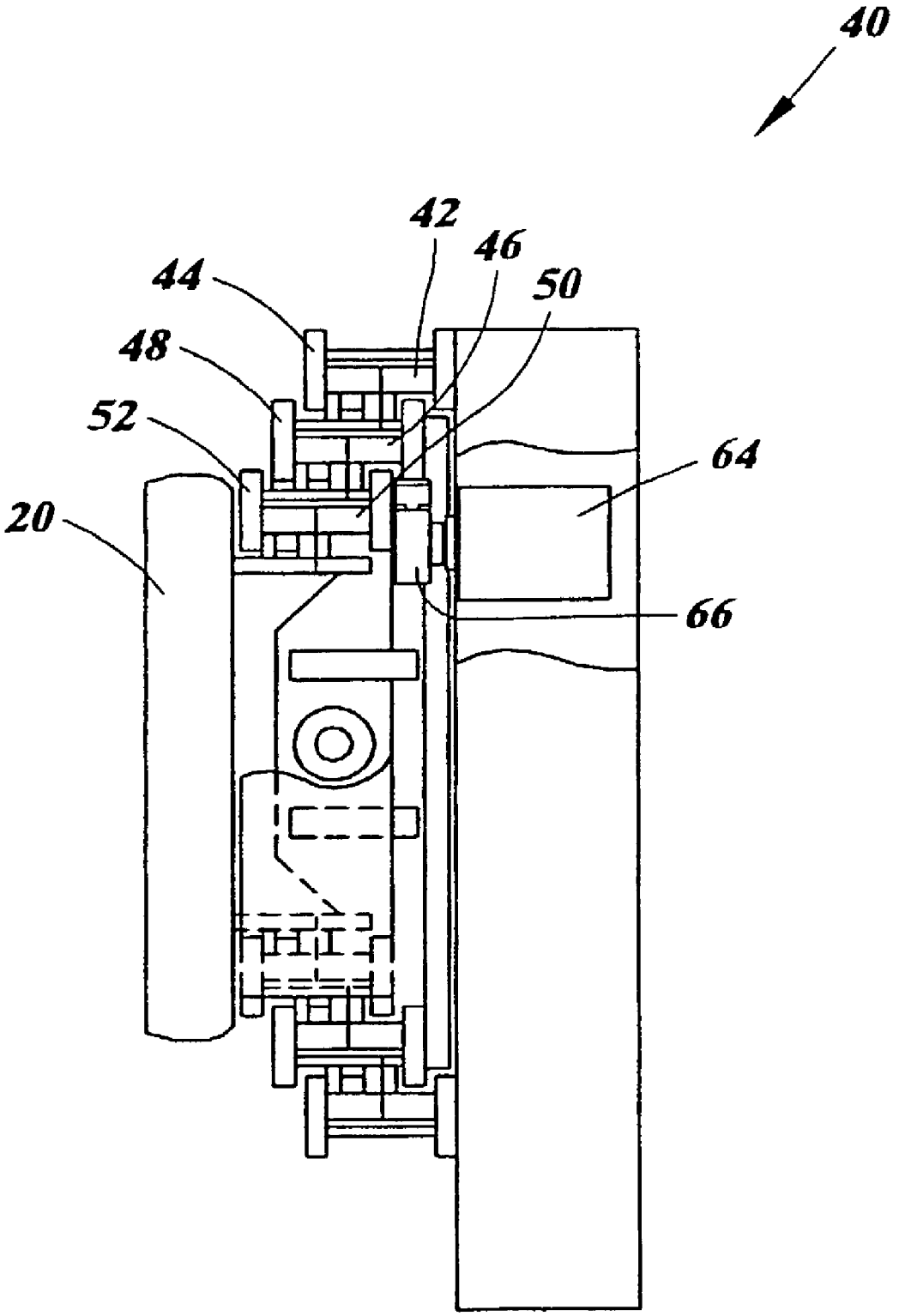
FIG. 4A is a side view of the side translating assembly shown in FIG. 2.
Figure 4B:
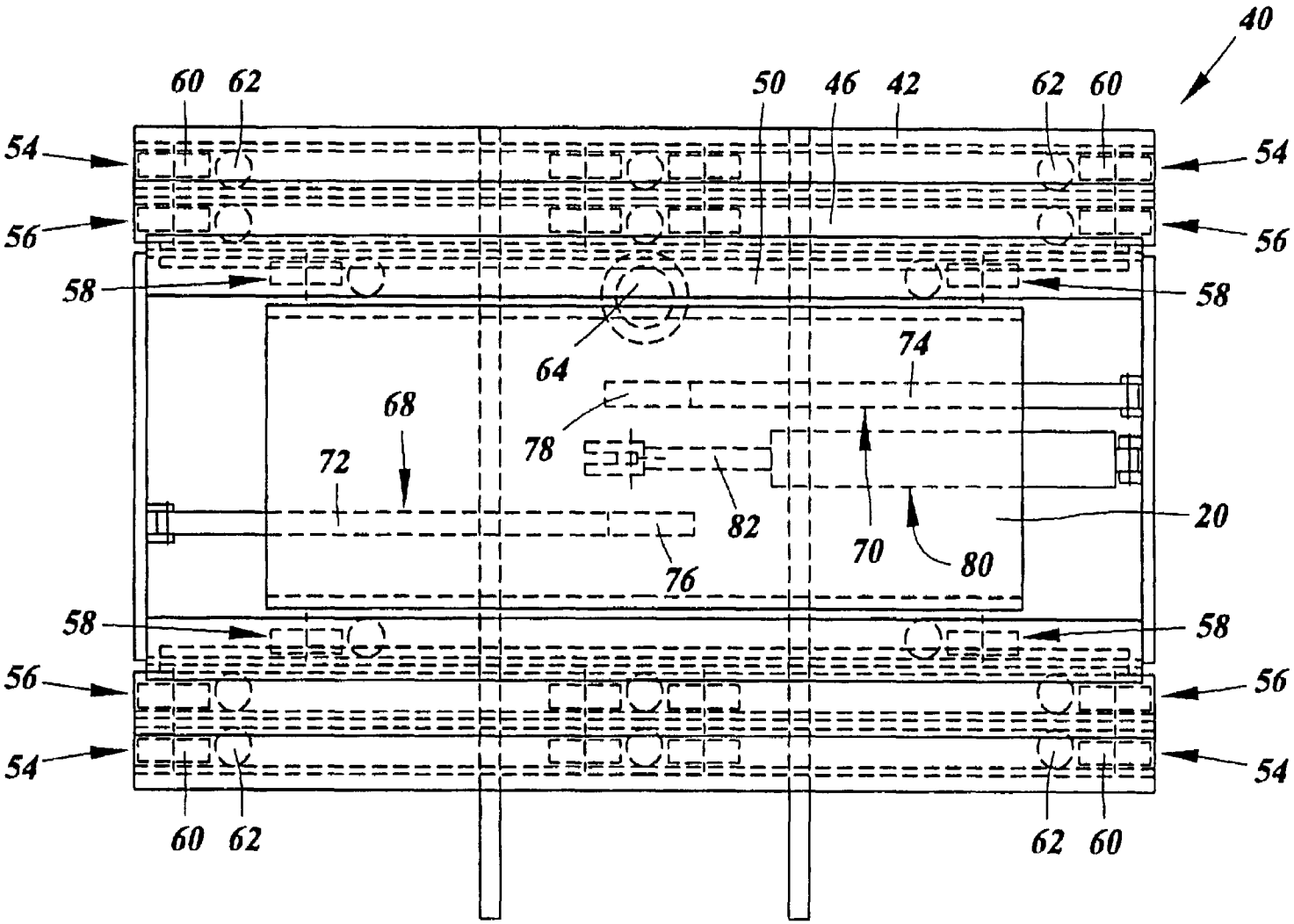
FIG. 4B is a front view of the side translating assembly of FIG. 2.
Figure 5:
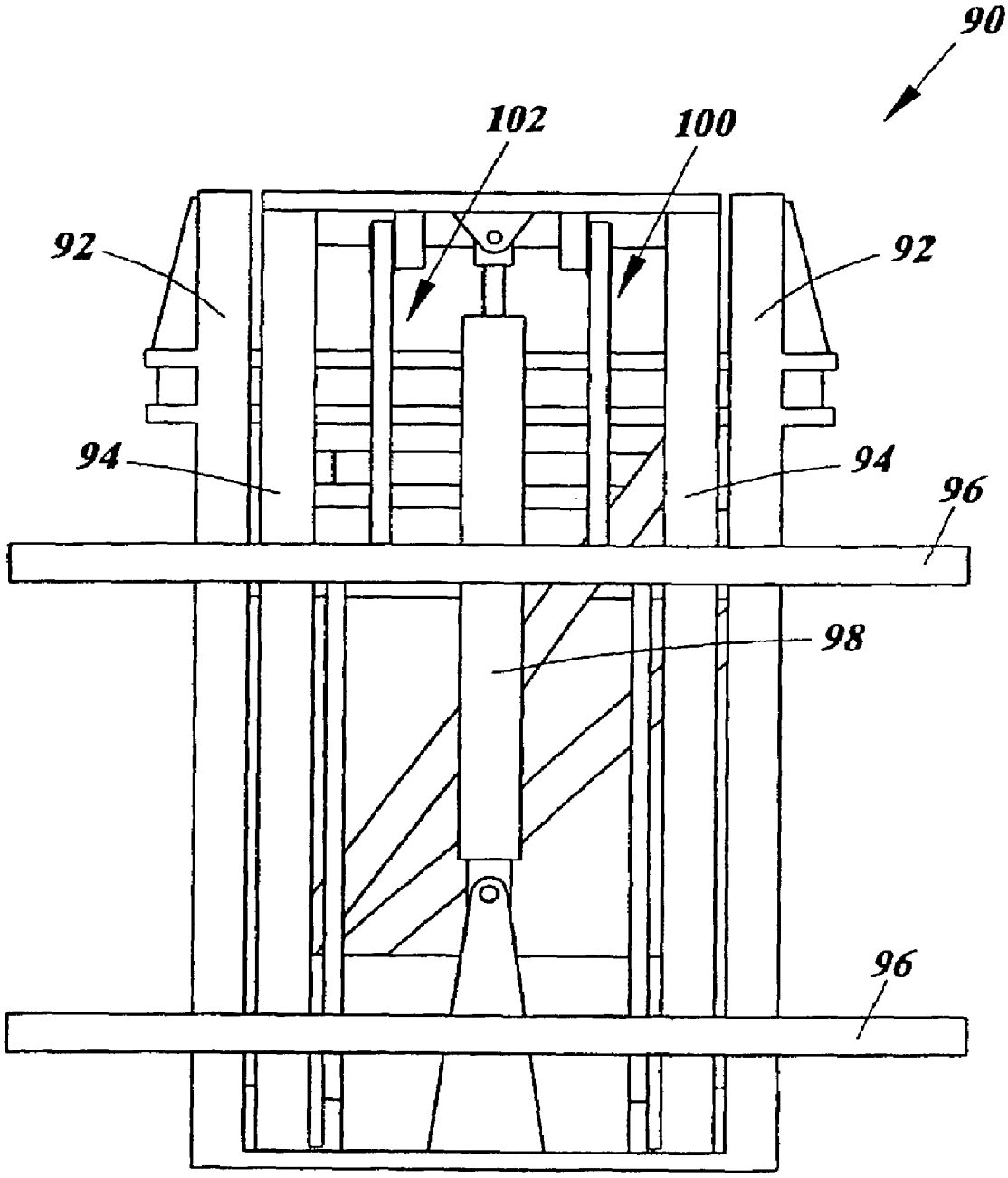
FIG. 5 is a front view of the lift mast assembly of FIG. 2.

The present invention is generally directed to a device or assembly for transferring a load or article wherein the device is movable vertically and laterally relative to a vehicle. The invention may be used with a variety of vehicles and in a variety of environments to transport a variety of loads, including newsprint rolls, pallets, and the like. Notwithstanding its general applicability, one embodiment of the invention is described herein with reference to, and has specific application for, an AS/R vehicle for newsprint applications. This application is more completely illustrated and described with reference to U.S. Pat. No. 5,076,751 entitled "Reelroom Newsprint Roll Handling Apparatus And Method" and issued Dec. 31, 1991 to Alfred J. Kafka, the entire content of which is hereby incorporated by reference. Notwithstanding the specific description of the embodiments illustrated and described herein, it should be appreciated that the device or assembly for transferring articles may be used with a variety of vehicles and with a variety of transfer device configurations without departing from the scope of the invention as defined by the appended claims.

Turning now to the first embodiment of the invention illustrated in FIGS. 2–5, FIG. 2 illustrates one example of the apparatus for transport and delivery of articles in accordance with the present invention. The apparatus includes a vehicle 10, which has a transfer device 20, a side translating assembly 40 and a lift mast assembly 90. The side translating assembly 40 is used to move the transfer device 20 between the center of the vehicle 10 and either side of the vehicle 10, and the lift mast assembly 90 is used to raise or lower the transfer device 20. This embodiment of the invention is used in a storage facility for storing paper rolls, although the invention may be used in a storage facility for storing any articles.

The vehicle may be of any suitable type. For example, the vehicle may be an automatic guided vehicle or it may be manually operated. In the preferred embodiment illustrated in FIG. 2, the vehicle 10 is an automatic guided vehicle. A vehicle of the present invention may further include additional useful features. For example, the vehicle may include a device for transport and delivery of specially designed newsprint waste containers.

The transfer device may be used to load an article placed in a storage rack or on the ground, unload the article in a storage rack or on the ground, and securely carry the article when the article is being transported. In the embodiment illustrated in FIGS. 3A and 3B, which is used for transport and delivery of paper rolls 2, the transfer device 20 has a hollow, generally cylindrical configuration. The exterior 22 and hollow interior 24 of the transfer device 20 may each have any suitable cross section. The cross section of the exterior 22 of the generally cylindrical transfer device 20 may be determined by the configuration of the storage rack 4 so that the transfer device 20 can extend into the storage rack 4, and the cross section of the hollow interior 24 of the transfer device 20 may be determined by the configuration of the articles to be transported. In general, the cross sections of the exterior 22 and hollow interior 24 of the generally cylindrical transfer device 20 may have any irregular or regular configuration, such as a circular or polygonal configuration. In the illustrated embodiment, the cross section of the exterior 22 of the transfer device 20 has a generally square configuration, while the cross section of the hollow interior 24 has a generally polygonal configuration. The transfer device 20 preferably has two open ends 26, 28 and a longitudinal opening 30. The longitudinal opening 30 intersects both open ends 26, 28 of the cylindrical transfer device 20. Alternatively, the transfer device may have only one open end and the longitudinal opening may intersect the open end. Whether the transfer device has one or two open ends may depend on whether the vehicle is designed to load from one or both sides.

To pick up a paper roll 2 placed in a storage rack 4, the transfer device 20 is first positioned with its axis substantially aligned with the axis of the roll 2 and with one of its open ends 26, 28 facing the roll 2. Then the transfer device 20 is moved towards the roll 2 and into the storage rack 4, so that at least a portion of the roll 2 enters the transfer device 20 from the open end 26, 28. The longitudinal opening 30 preferably faces downwards when the transfer device 20 is installed in the vehicle 10, allowing the transfer device 20 to accommodate the portion of the roll 2 that contacts the storage rack 4 as the roll 2 enters the transfer device 20. The transfer device 20 is then raised by the lift mast assembly 90 to place the roll 2 in the transfer device 20. Preferably, the width of the longitudinal opening 30 is less than the diameter of the roll 2 but is sufficiently large that the longitudinal opening 30 can accommodate the portion of the roll 2 that contacts the storage rack 4. Further, the inner diameter and open ends 26, 28 of the transfer device 20 are sufficient large that the paper roll 2 can enter the transfer device 20 from one of the open ends 26, 28. The length of the transfer device 20 may be longer than, equal to, or shorter than the length (height) of the paper rolls 2.

If the paper roll 2 is placed on a pallet, the transfer device 20 may pick up the roll as well as the pallet. In this case, the pallet may be specially configured so that the transfer device 20 can engage the pallet to lift it. With this arrangement, paper rolls having diameters smaller than the width of the longitudinal opening may still be picked up by the transfer device 20.

The transfer device may have a number of alternative configurations. For example, the transfer device may have a semi-cylindrical configuration with an open top. A transfer device of this configuration does not fully enclose the paper roll being transported but provides sufficient support to the paper roll so that it does not roll off the transfer device. Further, to reduce the weight of the transfer device, the transfer device may be made from ribs or metal meshes rather than from a solid piece.

The side translating assembly can be of any suitable mechanism that can move the transfer device between the center of the vehicle to one or either side of the vehicle to load and unload articles. In the preferred embodiment shown in FIGS. 4A and 4B, the side translating assembly 40 includes one or more horizontal rails positioned perpendicularly with respect to the direction of vehicle travel. The side translating assembly 40 includes an outer section 42 having a pair of outer rails 44, an intermediate section 46 having a pair of intermediate rails 48, and an inner section 50 having a pair of inner rails 52. The outer section 42 may be attached to the lift mast assembly 90, and the outer rails 44 may support and guide roller assemblies 54 attached to the intermediate section 46 so that the intermediate section 46 can slide relative to the outer section 42 to either side of the vehicle 10. The intermediate rails 48, in turn, may support and guide the roller assemblies 56 attached to the inner section 50, and the inner rails 52 may support and guide the roller assemblies 58 attached to the transfer device 20. The roller assemblies 54, 56, 58 are provided to facilitate the relative movement between two sections 42, 46, 50 and between the inner section 50 and the transfer device 20. While the side translating assembly 40 shown in FIGS. 4A and 4B has three sections 42, 44, 50, a side translating assembly of the present invention may include any number of sections, depending on the amount of travel required of the transfer device. For example, a side translating assembly may include only one section that may support and guide the roller assemblies of the transfer device. Alternatively, a side translating assembly may include the outer section and intermediate section, and the intermediate section may support and guide the roller assemblies of the transfer device.

Each rail usually engages at least two roller assemblies but may engage any number of roller assemblies. In the preferred embodiment shown in FIGS. 4A and 4B, each of the outer and intermediate rails 44, 48 engages three roller assemblies 54, 56 while each of inner rails 52 engages two roller assemblies 58. Each roller assembly 54, 56, 58 may include at least one horizontal roller 60 and at least one vertical roller 62. The horizontal and vertical rollers 60, 62 allow the roller assembly 54, 56, 58 to carry horizontal and vertical loads, respectively. In some embodiments of the invention, the rails and roller assemblies may be replaced by any suitable devices that allow one section to slide against another section with relative ease.

The relative movement between two sections or between the inner section and the transfer device can be effected using any suitable means. In the illustrated embodiment, the relative movement between the outer section 42 and the intermediate section 46 is effected by a first actuator 64. Although the first actuator may be an actuator of any suitable type, the first actuator 64 in the illustrated embodiment is a rotary motor mounted on the outer section 42. And the moving member 66 of the rotary motor 64 is connected to the intermediate section 46 via a rack-pinion mechanism. With the rack-pinion mechanism, the rotation of the moving member 66 of the rotary motor 64 generates relative linear movement between the outer and intermediate sections 42, 46. Alternatively, the first actuator may be a linear actuator mounted on one of the outer and intermediate sections 42, 46, and the moving member of the linear actuator may be connected to the other of the outer and intermediate sections 42, 46. The extension and retraction of the linear actuator generates relative linear movement between the outer and intermediate sections 42, 46.

The relative movement between the intermediate and inner sections 46, 50 preferably is effected using two chain-sprocket arrangements 68, 70, although it can also be effected with any suitable arrangement, such as an actuator. Each chain-sprocket arrangement 68, 70 includes a chain 72, 74 with one of the chain's ends connected to the outer section 42 and the other end connected to the inner section 50. Each chain 68, 70 forms a loop around a sprocket 76, 78 rotatably mounted on the intermediate section 46. With these chain-sprocket arrangements 68, 70, the relative movement between the outer and intermediate sections 42 46 produces relative movement between the intermediate and inner sections 46, 50 in the same direction. For example, when the first actuator 64 is activated to move the intermediate section 46 to the right, the sprocket 76, which is attached to the intermediate section 46, of the first chain-sprocket arrangement 68 pulls the chain 72 to the right. The chain 72 then pulls the inner section 50 to the right at about twice the speed of the intermediate section 46. Similarly, the movement of the intermediate section 46 to the left also causes the inner section 50 to move to the left by means of the second chain-sprocket arrangement 70. Alternatively, another type of arrangement, such as a gear arrangement, may be used in place of the chain-sprocket arrangements 68, 70.

In the illustrated embodiment, the relative movement between the inner section 50 and the transfer device 20 is effected by a second actuator 80. The second actuator 80 may be a linear motor mounted on the inner section 50, and the moving member 82 of the actuator 80 may be connected to the transfer device 20. With this arrangement, the extension and retraction of the linear actuator 80 may generate relative movement between the inner section 52 and the transfer device 20. With this arrangement, the relative movement between the inner section 50 and the transfer device 20 may be independent of the relative movement between the outer section 42 and the intermediate section 46. Alternatively, another pair of chain-sprocket arrangements may be used, in place of the second actuator 80, to generate relative movement between the inner section 50 and the transfer device 20 using the relative movement between the intermediate section 46 and the inner section 50. In this way, only one actuator is needed. Additionally, the second actuator may be a rotary actuator similar to the first actuator 64.

The lift mast assembly may be any suitable mechanism that can move the side translating assembly vertically. The lift mast assembly may be placed at either the front or rear end of the vehicle. In the preferred embodiment shown in FIG. 5, the lift mast assembly 90, placed at the rear end of the vehicle 10, includes an outer mast 92, an inner mast 94, a carriage member 96 and a lift actuator 98. The outer mast 92, attached to frame of the vehicle 10, has a rectangular configuration with two vertical sections and two horizontal sections. The outer mast 92 also includes two rails attached to the two vertical sections, respectively. These two rails function as support and guide for the roller assemblies attached to the inner mast 94, allowing the inner mast 94 to slide relative to the outer mast 92 in the vertical direction. The inner mast 94 has a configuration similar to that of the outer mast 92, with two vertical sections, two horizontal sections and two rails disposed on the two vertical sections, respectively. The two rails of the inner mast 94 function as support and guide for the roller assemblies of the carriage section 96 so that the carriage section 96 can slide relative to the inner mast 94 in the vertical direction. The side translating assembly 40 are attached to the carriage section 96 of the lift mast assembly 90. The roller assemblies of the lift mast assembly 90 are similar to the roller assemblies of the side translating assembly 40.

The relative movement between the outer mast 92 and the inner mast 94 may be effected using a linear actuator 98 which, in the illustrated embodiment, is a piston-cylinder arrangement. The relative movement between the inner mast 94 and the carriage section 96 is effected using a pair of parallelly arranged chain-pulley arrangements 100, 102. The chain-pulley arrangements 100, 102 are similar to the chain-sprocket arrangements 68, 70 of the side translating assembly 40. One end of each chain is attached to the base portion of the outer mast 92 while the other end is attached to the top portion of the carriage section 96, and the chain wraps over the pulley attached to the inner mast 94. Extension of the linear actuator 98 raises the inner mast 94 and the pulleys attached thereto. Upward movement of the pulleys pulls up the chains and the carriage section 96 attached to the chain. This upward movement of the carriage section 96 lifts the outer section 42 of the side translating assembly 40 attached to the carriage section 96. Each of the inner mast 94 and carriage section 96 can be lowered by its own weight when the linear actuator 98 retracts.

In operation, the vehicle 10 is directed to the aisle in which the paper roll 2 to be picked up is located. The vehicle 10 may enter the aisle from either direction because the vehicle 10 is designed to load paper rolls 2 from either side of the vehicle 10 because the transfer device 20 has two open ends 26, 28. The vehicle 10 is stopped to position the transfer device 20 in front of the column of storage racks 4 in which the paper roll 2 to be picked up is located. Then the transfer device 20 is raised or lowered by the lift mast assembly 90 to align the transfer device 20 with the roll 2 to be picked up. The side translating assembly 40 then extends the transfer device 20 towards the paper roll 2 until the roll 2 is placed in the transfer device 20. The transfer device 20 may be moved by activating one or both of first and second actuators 64, 80. In some cases, one actuator 64, 80 may be sufficient to generate the desired movement of the transfer device 20, while in other cases, two actuators 64, 80 may be needed to generate the desired movement. Because the exterior configuration 22 of the transfer device 20 is specifically designed to conform to the configurations of the storage rack 4 and the side translating assembly 40 has a narrow configuration, the size of the storage racks 4 needs not be increased significantly to accommodate the transfer device 20 and the side translating assembly 40. Next, the lift mast assembly 90 raises the transfer device 20 to lift the roll 2 off the storage rack 4 and to place the roll 2 in the transfer device 20. After the roll 2 has been picked up, the side translating assembly 40 brings the transfer device 20 and the roll 2 contained therein back onboard the vehicle 10. The vehicle 10 then transports the roll 2 to the drop off point. The procedure for dropping off a roll 2 in a storage rack 4 is similar to the pick up procedure but the process is reversed in some steps.

Turning now to FIGS. 6–11 wherein an AS/R vehicle application is described with reference to a newsprint roll handling application. In a manner similar to the above embodiment, the AS/R vehicle includes a vertical carriage assembly that is capable of retrieving the load from a position that is located at approximately the same elevation as, or even a lower elevation than, the wheeled base of the vehicle. This capability provides numerous operational and design benefits including eliminating the use of cradles to support stored loads thereby more effectively using available storage space. The orientation of the vertical carriage components also permits the vertical carriage and the vehicle to more effectively accommodate operational loadings as hereinafter described. While the invention has widespread application, it is particularly suited for AS/R machines as the improvement eliminates the need for, and costs associated with, rail and storage pits commonly required for prior AS/R machine designs.

Figure 6:
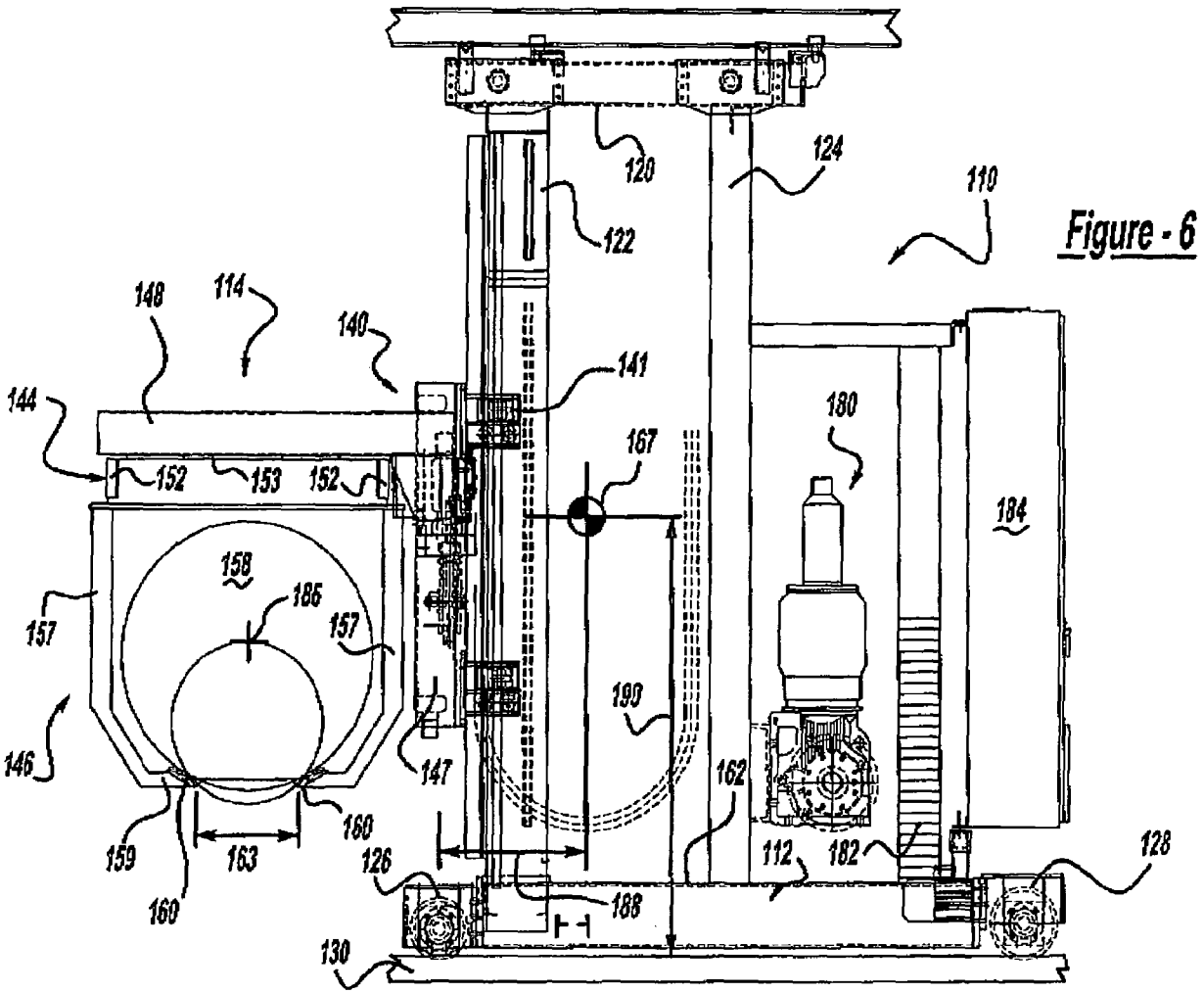
FIG. 6 is a side elevational view of a vehicle according to a second embodiment of the present invention.
Figure 7:
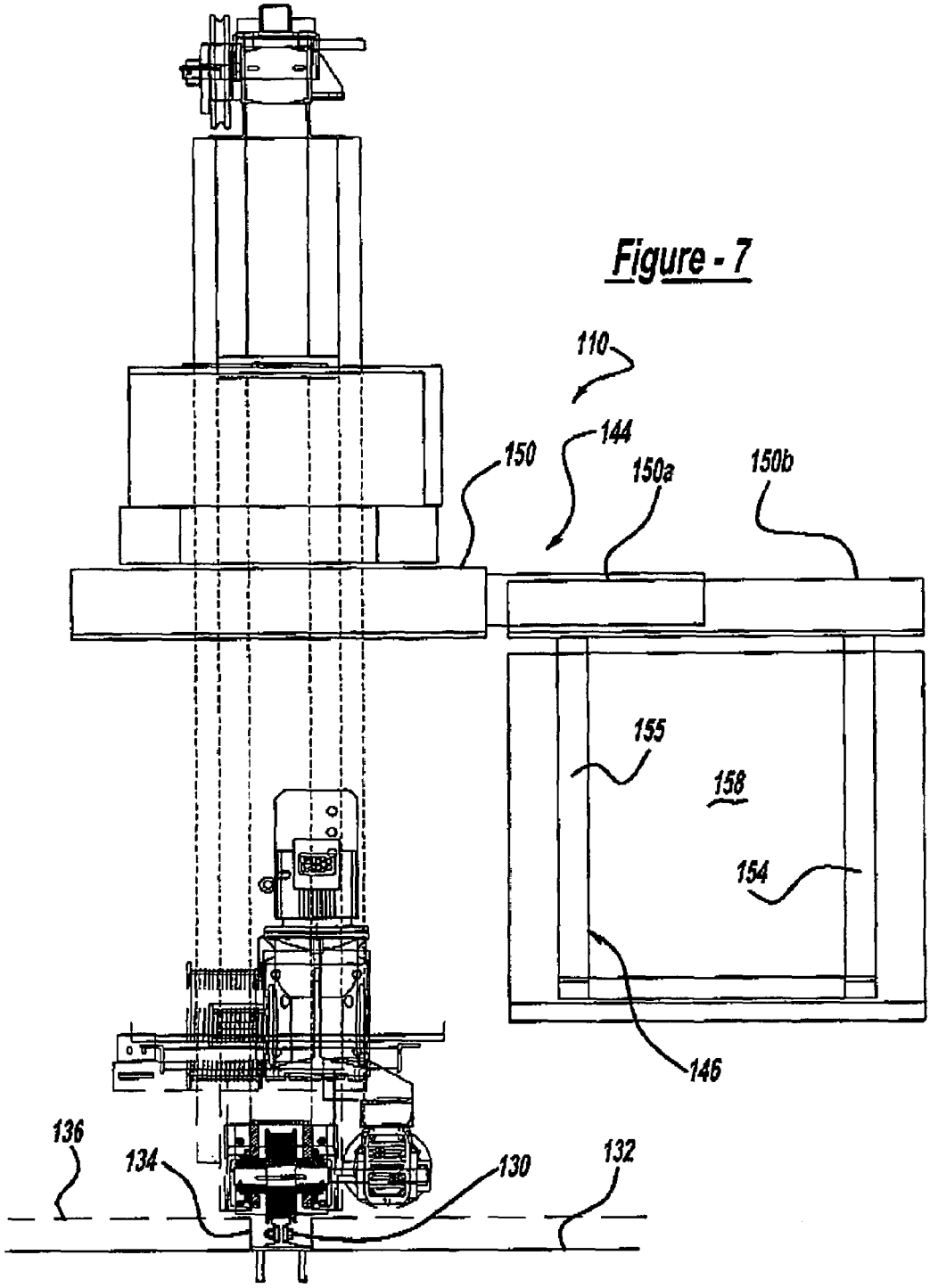
FIG. 7 is a front elevational view of the vehicle illustrated in FIG. 6.
Figure 8:
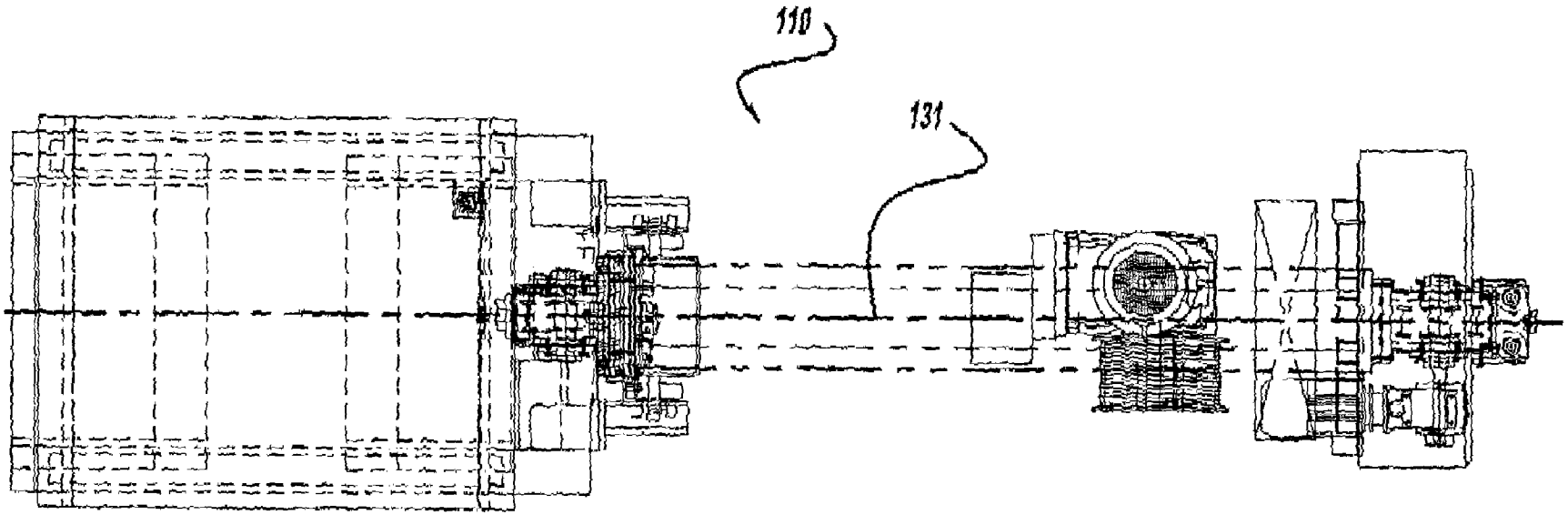
FIG. 8 is a top plan view of the vehicle illustrated in FIG. 6.

A representative AS/R vehicle 110 is illustrated in FIGS. 6–9 to generally include a truck 112, a vertical carriage 114, and fore and aft masts 122 and 124, respectively, extending upwardly from the truck and connecting an upper guide frame 120 to the truck. The vertical carriage 114 includes a transfer device or carrier that, just like the embodiment described with reference to FIGS. 1–5, is movable in vertical and horizontal directions to permit the vehicle to capture and release loads from the right and left sides of the vehicle. The AS/R vehicle truck 112 includes idler and drive wheels 126 and 128 that operatively engage a lower guide rail 130 to define the direction of movement of the vehicle. Thus, the lower guide rail 130 defines an axial direction that is parallel with a vehicle axis 131 as shown in FIG. 8. While a specific vehicle type and configuration is illustrated and described herein, it should be appreciated that a variety of alternative material handling vehicle types and specific AS/R vehicle configurations, including single mast vehicles, may be used without departing from the scope of the invention as defined by the appended claims.

As is illustrated in FIG. 7, the rail 130 may be fixed to and extend upwardly from the building floor 132 or, as is illustrated in shadow, may be disposed within a narrow trench 134 formed in a floor 136. Using the narrow rail trench 134 shown in shadow in FIG. 7 may be desirable to recess the rail from the surrounding surface to permit more effective storage and/or continuous walkways. However, contrary to the teachings of the prior art, the vehicle of the present invention does not require that the rail and/or the entire wheeled truck be recessed in a pit or trench in order to permit the vertical carriage to pick-up or deliver articles directly from or to the building floor 132 and therefore effectively use the available storage space.

In the illustrated embodiment, the vertical carriage 114 is operatively coupled to the fore mast 122 through guide roller assemblies 141 that are fixed to move with the vertical carriage support frame 140 and engage the fore mast 122 to guide the vertical movement of the carriage. Frame 140 has a substantially vertical section 147 fixed to a cantilevered and substantially horizontal frame section 148. A variety of hoist drives generally known in the art such as a chain-pulley assembly, linear actuator, or the like may be used to lift and lower the carriage. The hoist design should adequately support the carriage and permit controlled movement of the carriage in a vertical direction.

The vertical carriage 114 also includes a translating assembly, which is referred to herein as shuttle 144, and a transfer device or carrier 146. The shuttle 144 is located below the cantilever frame 148 and operably connects the carrier 146 to the cantilevered frame 148 to permit lateral movement of the carrier to the sides of the vehicle, and substantially perpendicular to axis 131 and rail 130 (FIG. 7). By suspending both the carrier and shuttle below the cantilevered frame 148, the load from the article is suspended directly below the shuttle. This arrangement permits the use of commonly available shuttles to more effectively support the newsprint roll loading. Accordingly, the carriage functions with less shuttle binding and more effectively withstands the significant torque loading present when the shuttle is fully laterally extended. Thus, the specific relative positioning of the vertical carriage components in the present embodiment more effectively capitalizes on presently available components to achieve maximum performance benefits at economical costs and manufacturing ease.

With reference to FIGS. 6 and 7, the illustrated bidirectional shuttle 144 includes a fixed section 150 and a pair of telescoping sections 150*a* and 150*b* that extend laterally to the right or left of the fixed section. The shuttle permits lateral extension and retraction of the carrier 146, which is fixed to move with section 150*b*, to facilitate capture of the load and to provide greater reach for increased storage capabilities. The telescoping rails 150*a* and 150*b* each include a pair of spaced legs 152 interconnected by a support plate 153. It is contemplated that the shuttle, while illustrated as a three stage assembly for single depth extraction, may include numerous alternate designs including five stage double-deep extracting shuttles. In the contemplated and commercially available shuttle design, the telescoping sections are driven by a main transmission (not shown) and a gear rack mounted underneath the intermediate telescoping section 150*a*. A variety of mechanical drives may be used, including a sheath and chain configuration, to drive the lower section 150*b* at twice the speed and distance of the intermediate section 150*a*. Such telescoping shuttles are presently available from Webb Triax, a subsidiary of the assignee of the present invention, located in Chardon, Ohio. One skilled in the art will appreciate that the illustrated configuration of the shuttle is provided for exemplary purposes and that a variety of equivalent shuttle and/or fork designs commonly known in the art may be substituted for the illustrated shuttle without departing from the scope of the present invention.

The configuration of the transfer device or carrier 146 shown and described with reference to FIGS. 6–11 operates in substantially the same way as the transfer device 20 of FIGS. 1–5 and has a similar configuration. However, the carriage 146 includes spaced first and second tongs 154 and 155, respectively, (FIG. 7) to provide a more lightweight carrier configuration that is particularly suitable for capturing and transporting a cylindrical load such as the illustrated newsprint roll 156. Each of the tongs include a pair of opposed ribs 157 spaced from one another to define a hollow article cavity 158 therebetween. A projection 159 extending into the cavity terminates at a distal end 160 that preferably includes a pivoting support plate. The distal ends of each of the projections are spaced from one another to define an opening 163 therebetween (FIG. 6). Each of the tongs 154 and 155 are similarly configured such that the corresponding openings 163 align in a lateral direction relative to the vehicle axis 131 to define an opening extending between opposed open ends of the carrier defined by the cavities 158. While the opening 163 is oriented laterally relative to the vehicle axis 131 it is positioned longitudinally relative to the carrier itself and is therefore referred to herein as a longitudinal opening 163.

Figure 9:
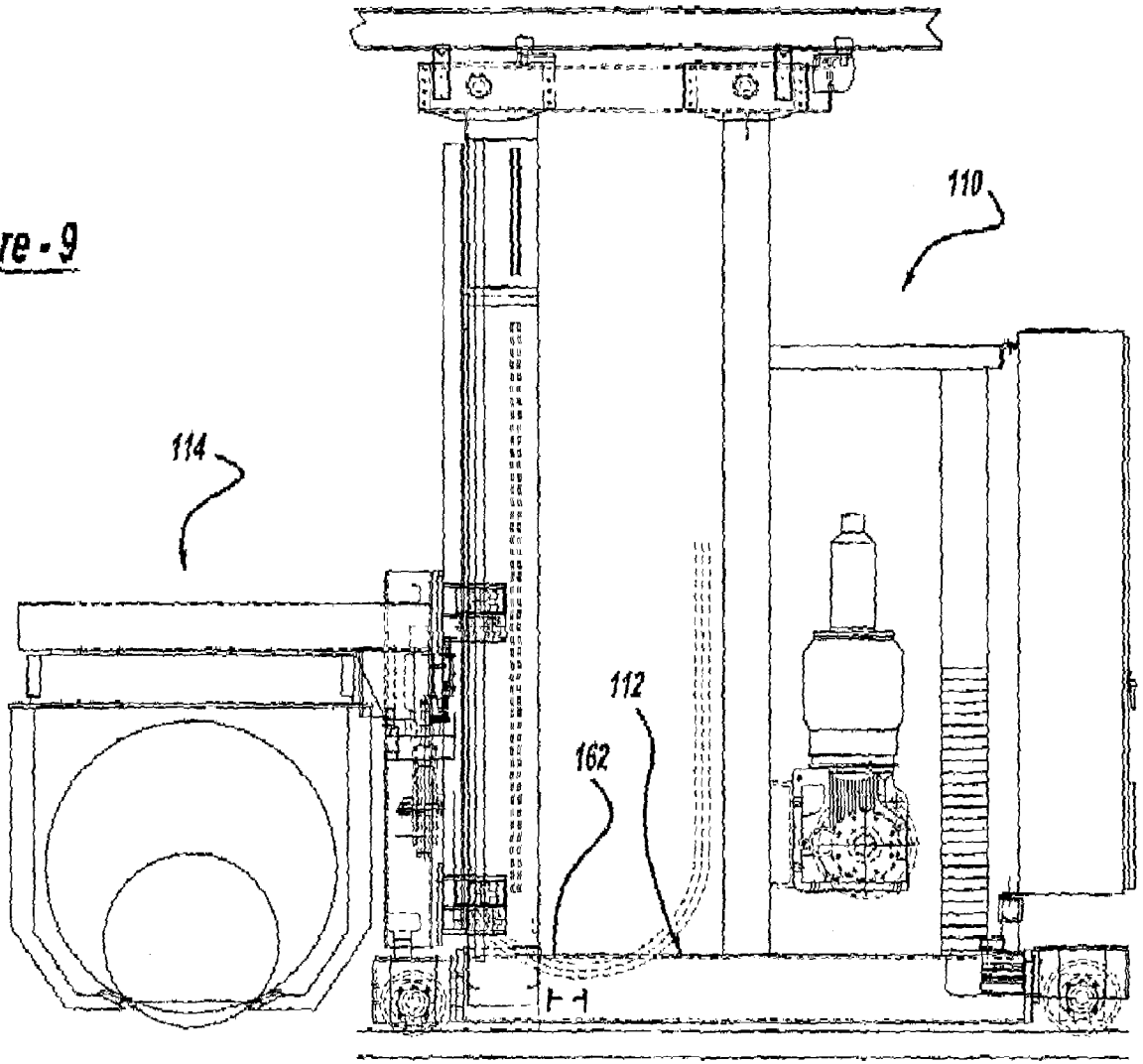
FIG. 9 is a side elevational view similar to that shown in FIG. 6 with the vertical carriage in its fully lowered position.
Figure 10:
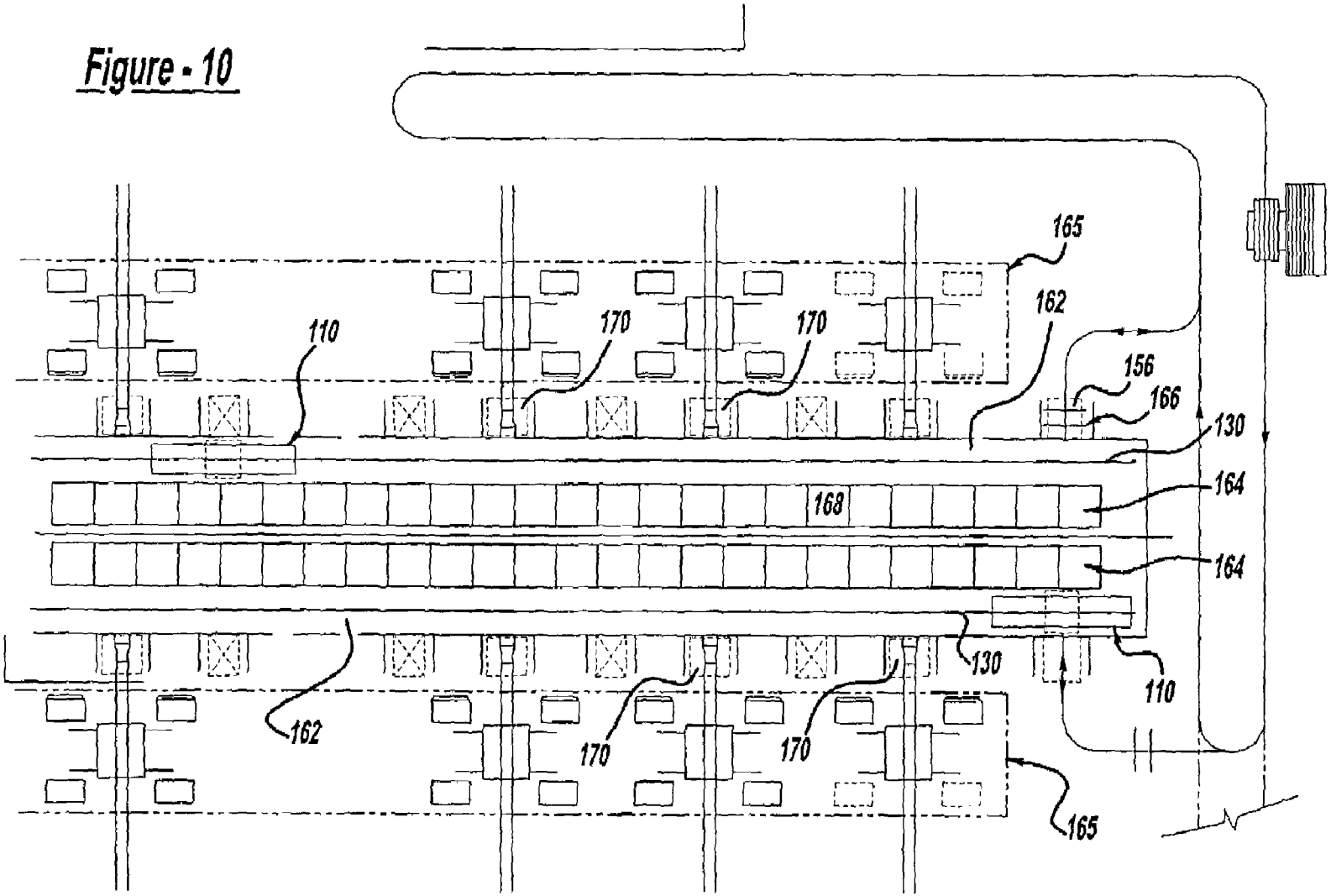
FIG. 10 is a schematic plan view of a representative press reelroom having a newsprint roll handling apparatus with the storage and retrieval machine of the present invention installed therein.

When the vertical carriage 114 is in its fully lowered position as shown in FIG. 9, the carrier 146 is positioned to store or retrieve a load resting at or below the upper surface 162 of the wheeled truck 112, including the support surface defined by the building floor 132 (FIG. 7). As noted above, the capability to store and retrieve loads positioned at an elevation at or below the upper surface of the wheeled truck permits the AS/R vehicle 110 to increase the available storage space without requiring additional headroom.

As is also noted above, the storage and retrieval machine 110 is particularly suitable for newsprint roll handling environments. In the newsprint roll handling apparatus schematically illustrated in FIG. 10, the vehicle 110 is movable longitudinally within an aisle 162 defined by the rail 130. The aisle extends adjacent and parallel to a rack 164 that faces a reelstand row 165. The storage and retrieval machine 110 is capable of moving the newsprint rolls 156 from and between a pick-up station 166, one of the plurality of storage bins 168 defining the rack 164, and the reelstand load stations 170 all without the need for any cradle or pedestal to support the roll above the floor.

One skilled in the art will appreciate that numerous frame and carrier configurations may be used with the present invention without departing from the proper scope thereof. Moreover, a variety of truck, vertical carriage, and shuttle drive mechanisms generally known in the art may be used. For completeness, a representative hoist drive assembly 180 (FIG. 6) for driving the vertical carriage 114 is illustrated as fixed to the aft mast 124. A counterweight 182 and control panel 184 are also shown fixed to the longitudinally rear portion of the truck 112. These components are placed toward the rear of and proximate the truck in order to counter the weight of the load and lower the center of gravity of the vehicle. In the illustrated embodiment where the newsprint roll weighs approximately 2,500 pounds, the motor assembly 180, counterweight 182, and control panel 184 are positioned 114", 134", 150" respectively from center 186 of newsprint roll so as to place the center of gravity 167 of the machine at a distance 188 from the center of the forward idler wheel 126 of about twenty-nine inches and a distance 190 from the bearing surface of the wheels of about eighty-two inches. Notwithstanding the specific description of the position of the hoist drive assembly, counterweight, and control panel, those skilled in the art will appreciate that these components may be modified in their structure and function as well as repositioned for a specific application without departing from the scope of the present invention.

Figure 11:
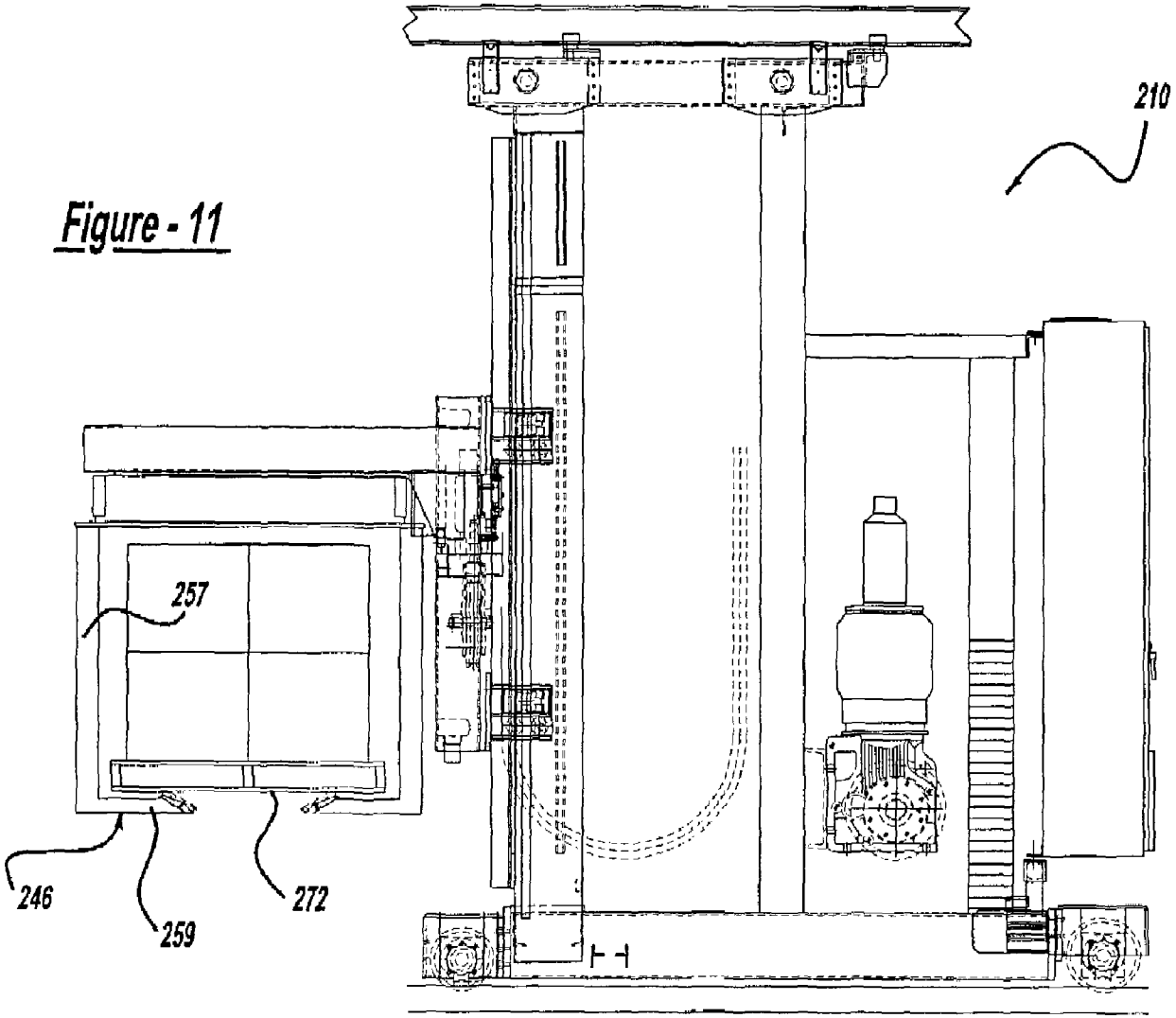
FIG. 11 is a side elevational view of a storage and retrieval machine according to the second embodiment of the present invention with an alternative tong configuration.

An AS/R vehicle 210 is illustrated in FIG. 11 wherein the carrier 246 includes tongs having an alternative configuration to that illustrated in FIGS. 6–9. The alternative tongs are generally rectangular in configuration to more readily permit the vehicle to transport pallets 272 in addition to the cylindrical newsprint rolls 156 shown in FIGS. 6–9. The pallets would be positioned on a cradle or pedestal to permit the projections 259 from the ribs 257 to pass under the pallets 272. This additional capability is useful in newsprint roll handling systems for a variety of reasons including the need to store and transport newspaper inserts, commonly shipped on pallets, proximate to the reelstand operation. It should be appreciated that the alternative configuration illustrated in FIG. 11 is not a necessity for transporting pallets with the present invention. As is illustrated in shadow in FIG. 7, appropriately dimensioned pallets may also be carried by the tong configuration shown in FIGS. 6–9.

The foregoing discussion discloses and describes an exemplary embodiment of the present invention. One skilled in the art will readily recognize from such discussion, and from the accompanying drawings and claims that various changes, modifications and variations can be made therein without departing from the true spirit and fair scope of the invention as defined by the following claims.

What is claimed is:

1. A vehicle for transport and delivery of an article comprising:

a vehicle body having a front, rear, first and second lateral sides, and a vehicle axis generally defining a direction of vehicle movement;

a transfer device having a transfer device axis approximately perpendicular to said vehicle axis, said transfer device having at least one substantially open end extending in a plane and a fixed longitudinal opening having a longitudinal axis intersecting the plane of the substantially open end, said fixed longitudinal opening being substantially arranged along said transfer device axis and having a width less than at least one dimension of the article;

a lift mast assembly coupled to the vehicle body and cooperatively associated with the transfer device to move the transfer device substantially vertically; and a side translating assembly coupled to the vehicle body and cooperatively associated with the transfer device to move the transfer device substantially horizontally between at least one of the first and second lateral sides of the vehicle and a center of the vehicle.

2. The vehicle of claim 1, wherein the transfer device is adapted to slide around the article so that at least a portion of the article enters the transfer device from the open end of the transfer device.

3. The vehicle of claim 1, wherein the transfer device has two open ends, said transfer device axis intersecting both open ends, and wherein the fixed longitudinal opening intersects both open ends.

4. The vehicle of claim 1, further including a vertical carriage having a horizontal support frame and wherein said side translating assembly is positioned vertically between the support frame and transfer device.

5. The vehicle of claim 4, wherein said transfer device is positioned below said side translating assembly and said side translating assembly is positioned below said horizontal support frame.

6. The vehicle of claim 4, wherein said transfer device includes a substantially horizontal mounting plate and first and second tongs spaced from one another and depending vertically downward from the mounting plate, wherein each of said first and second tongs include a pair of opposed ribs, said ribs being spaced from one another to define an article cavity therebetween, wherein each of said ribs include an inward projection terminating in spaced relation to one another to define a gap therebetween, wherein said gap of said first tong and said gap of said second tong are aligned to define said longitudinal opening, and wherein the article cavity of one of the first and second tongs defines the at least one substantially open end of the transfer device.

7. The vehicle of claim 1, wherein said vehicle body includes a wheeled truck riding on a support surface, said wheeled truck including an upper surface, and wherein said transfer device is vertically movable relative to said wheeled truck to a fully lowered position where the transfer device extends below the elevation of an upper surface of the wheeled truck to permit the vehicle to pick up and deliver articles from and to the support surface.

8. The vehicle of claim 7, wherein said wheeled truck includes a wheel adapted to engage a lower guide rail and an upper guide frame adapted to engage an upper guide rail, said upper guide frame being coupled to said mast and vertically spaced from said wheeled truck.

9. The vehicle of claim 7, wherein said fixed longitudinal opening faces said support surface.

10. The vehicle of claim 1, wherein the side translating assembly is attached to the lift mast assembly and wherein the side translating assembly includes an outer section having rails, an intermediate section having rails, and an inner section having rails, the transfer device being supported and guided by the rails of the inner section to travel horizontally between at least one side of the vehicle and the center of the vehicle, the inner section being supported and guided by the rails of the intermediate section to travel horizontally between at least one side of the vehicle and the center of the vehicle, the intermediate section being supported and guided by the rails of the outer section to travel horizontally between at least one side of the vehicle and the center of the vehicle.

11. The vehicle of claim 1, wherein said lift mast assembly, side translating assembly, and transfer device are positioned at the front or rear of the vehicle.

12. The vehicle of claim 1, wherein said transfer device includes a top and spaced side walls, said fixed longitudinal opening being located between said side walls, wherein one of said top and side walls of said transfer device is connected to said side translating assembly, wherein said side translating assembly is connected to said lift mast assembly, and said lift mast assembly is positioned at the front or rear of said vehicle.

13. The vehicle of claim 12, wherein one of said side walls of said transfer device is connected to said side translating assembly and wherein said side translating assembly does not extend above said top of said transfer device.

* * * * *

UNITED STATES PATENT AND TRADEMARK OFFICE

CERTIFICATE OF CORRECTION

PATENT NO. : 7,011,487 B2
APPLICATION NO. : 10/221048
DATED : March 14, 2006
INVENTOR(S) : Alfred J. Kafka et al.

It is certified that error appears in the above-identified patent and that said Letters Patent is hereby corrected as shown below:

Column 1, line 14, after "Field Of the Invention" please insert the following paragraph:

--This invention is related to apparatus for transport and delivery articles. More particularly, the invention is related to apparatus, including a vehicle and a transfer device, for loading, unloading and transporting articles, such as rolls of paper.--

Signed and Sealed this

Twenty-ninth Day of August, 2006

JON W. DUDAS
*Director of the United States Patent and Trademark Office*